US006024031A

United States Patent [19]

Stiefel

[11] Patent Number: 6,024,031

[45] Date of Patent: Feb. 15, 2000

[54] WATER-COOLED THRUST COMBUSTION GRATE

[75] Inventor: Jakob Stiefel, Kollbrunn, Switzerland

[73] Assignee: Doikos Investments Limited, St. Helier/Jersey, United Kingdom

[21] Appl. No.: 09/063,917

[22] Filed: Apr. 21, 1998

[30] Foreign Application Priority Data

Apr. 23, 1997 [CH] Switzerland ..... 0936/97

[51] Int. Cl.[7] ..... F23H 7/08; F23H 1/02

[52] U.S. Cl. ..... 110/281; 110/268; 110/298; 126/175; 126/163 R; 126/152 B

[58] Field of Search ..... 110/267, 268, 110/281, 286, 298, 299, 300; 126/152 R, 163 R, 174, 175, 152 B

[56] References Cited

U.S. PATENT DOCUMENTS 5,549,471 8/1996 Tegtmeier et al. ..... 110/281 X
5,673,636 10/1997 Stiefel .

FOREIGN PATENT DOCUMENTS 0621449 8/1995 European Pat. Off. .
00413 12/1994 WIPO .

*Primary Examiner*—Ira S. Lazarus
*Assistant Examiner*—Ljiljana V. Ciric
*Attorney, Agent, or Firm*—Pauley Petersen Kinne & Fejer

[57] ABSTRACT

A thrust combustion grate for burning refuse having alternately stationary (5) and movable (6) hollow grate plates (5,6) in a stairway formation, that rest on each other with their front underedge. The grate plates extend across the entire width of the grateway. The movable grate plates (6) are each driven by a hydraulic cylinder-piston unit (18,19). To the sides, the grateway is limited by panels of water-cooled conduits (8,9), which, in the longitudinal direction, each consist of at least two sections sealingly flanged together. The panels are rigidly screwed to each other by a plurality of horizontally disposed distancing bars (3,4) running perpendicular thereto. Running between the panels are two additional conduits (10,11) flanged together in the same way, for feeding primary air and cooling water, which are fixed to certain individual distancing bars (3,4). The back sides of the stationary grate plates (5) each rest on one distancing bar (3) while the back sides of the movable grate plates (6) rest on at least one steel roller (16,17) with a horizontal axis, with each side of their front sides being guided along a steel roller (20,21) whose axis runs perpendicular to the grate plate (6). The front portions of the grate plates (6) form by primary air slots (25).

16 Claims, 5 Drawing Sheets

WATER-COOLED THRUST COMBUSTION GRATE

BACKGROUND OF THE INVENTION

1. Field of the Invention

This invention relates to a water-cooled thrust combustion grate for refuse combustion plants that is particularly well suited for the combustion of refuse and waste with high heating values. Such thrust combustion grates have stationary and movable grate levels comprising grate plates or a row of grate bars, with the grate plates resting on top of each other in a stair-like manner. These thrust combustion grates can be assembled so that the combustion bed is essentially horizontal, or possibly inclined, with slopes of up to 20 degrees or more being usual. The grate plates are preferably made from sheet steel and form panel-shaped hollow elements which extend across the entire width of a grateway, through which water is fed as a cooling medium. Every second grate plate is movable, allowing it to perform a stoking or transporting stroke. In the case of a forward feed grate, the leading edge of the movable grate plates pushes material to be combusted forward onto the next grate plate down. In contrast thereto, a reverse feed grate forms a back to front built-in sloped stairway, so to speak. In a reverse feed grate, the leading edges of the movable grate plates transport the material behind them backwards which then rolls back down the slope of the grate. The movable grate plates, i.e. the grate plates in-between two stationary grate plates, are usually moved collectively to and fro in the downward direction of their inclination. This ensures that burning refuse lying on the grate for high dwell times of 45 to 120 minutes is constantly turned over and distributed evenly over the grate.

2. Description of Prior Art

European patent document EP-0'621'449 discloses a water-cooled thrust combustion grate. This grate has grate plates which extend over the entire width of the grateway, that is, which do not comprise a plurality of grate bars per grate level. The movable grate plates, like the stationary ones, are suspended by their back edge on crossbars which, when operated, move collectively forwards and backwards, thereby displacing the movable grate plates. One of the disadvantages of this means of driving the movable grate plates is that any small item that becomes jammed at the side between the grate plate and the outer side panel can cause the grate plate to skew to the side; that is, as seen from the top, the plate no longer lies exactly parallel to the adjoining stationary grate plates. If it is then displaced while in this position, high leverage forces occur, as a result of which the plate comes into contact with the outer side panels. The drive forces then required are correspondingly high. The wear caused by the enormous friction force is considerable and reduces the service life of the entire grate. Furthermore, the drive means is designed in such a way that an individual drive for each movable grate plate, which would be desirable to optimize the combustion process, could only be installed at phenomenal cost.

International Patent Application PCT/IB94/004113 discloses a thrust grate module featuring individual drives for the movable grate plates. Here, the movable grate plates roll on steel rollers, but are only guided with respect to the outer side panels by means of sliding friction. The drive is effected by hydraulic piston-cylinder units which come into contact with the approximate center of the grate plates. Even with this construction, skewing to the side is impossible to avoid. If a small particle gets jammed between the grate plate and an outer side panel, very high friction forces occur which, firstly, require correspondingly large hydraulic cylinders to overcome them and, secondly, cause correspondingly high wear.

SUMMARY OF THE INVENTION

Accordingly, it is one object of this invention to create a water-cooled thrust combustion grate in which the movable grate levels are individually displaceable and cause very little wear, thereby prolonging their service life and allowing the combustion process to be optimized in a targeted manner, and in which the refuse that falls through the grate is kept to a minimum. It is another object of this invention to provide a thrust combustion grate that is simple to assemble and easy to service, in that in one special version, it can be accessed from underneath during the combustion process, from where the individual drives of the grate plates can be replaced separately.

These and other objects of this invention are achieved by a water-cooled thrust combustion grate for burning refuse comprising alternately stationary and movable hollow grate plates in a stairway formation that rest on each other with their front underedge, of which each one extends across the entire width of the grateway, or a plurality of adjacently assembled plates that extend across the entire width of the grateway, with each movable grate plate being driven by a hydraulic cylinder-piston unit, which is limited at the sides by panels comprising water-cooled conduits, which, in the longitudinal direction, each consist of at least two sections sealingly flanged together. These panels are rigidly screwed to each other by a plurality of horizontally disposed distancing bars that run perpendicular to them. Running between the panels are two other conduits flanged together in the same way for feeding flushing air and cooling water, which are fixed to certain individual distancing bars. The back side of each stationary grate plate rests on one distancing bar while the back side of the movable grate plates rests on at least one steel roller with a horizontal axis, with each side of their front side being guided by a steel roller, the axis of which runs perpendicular to the grate plate. The front portion of each grate plate is sealingly transpierced by ducts with an elongated hole-shaped cross-section for feeding flushing air, so that these ducts project beyond the surface of the grate plates.

BRIEF DESCRIPTION OF THE DRAWINGS

These and other objects and features of this invention will be better understood from the following detailed description taken in conjunction with the drawings wherein.

DESCRIPTION OF PREFERRED EMBODIMENTS

Figure 1:
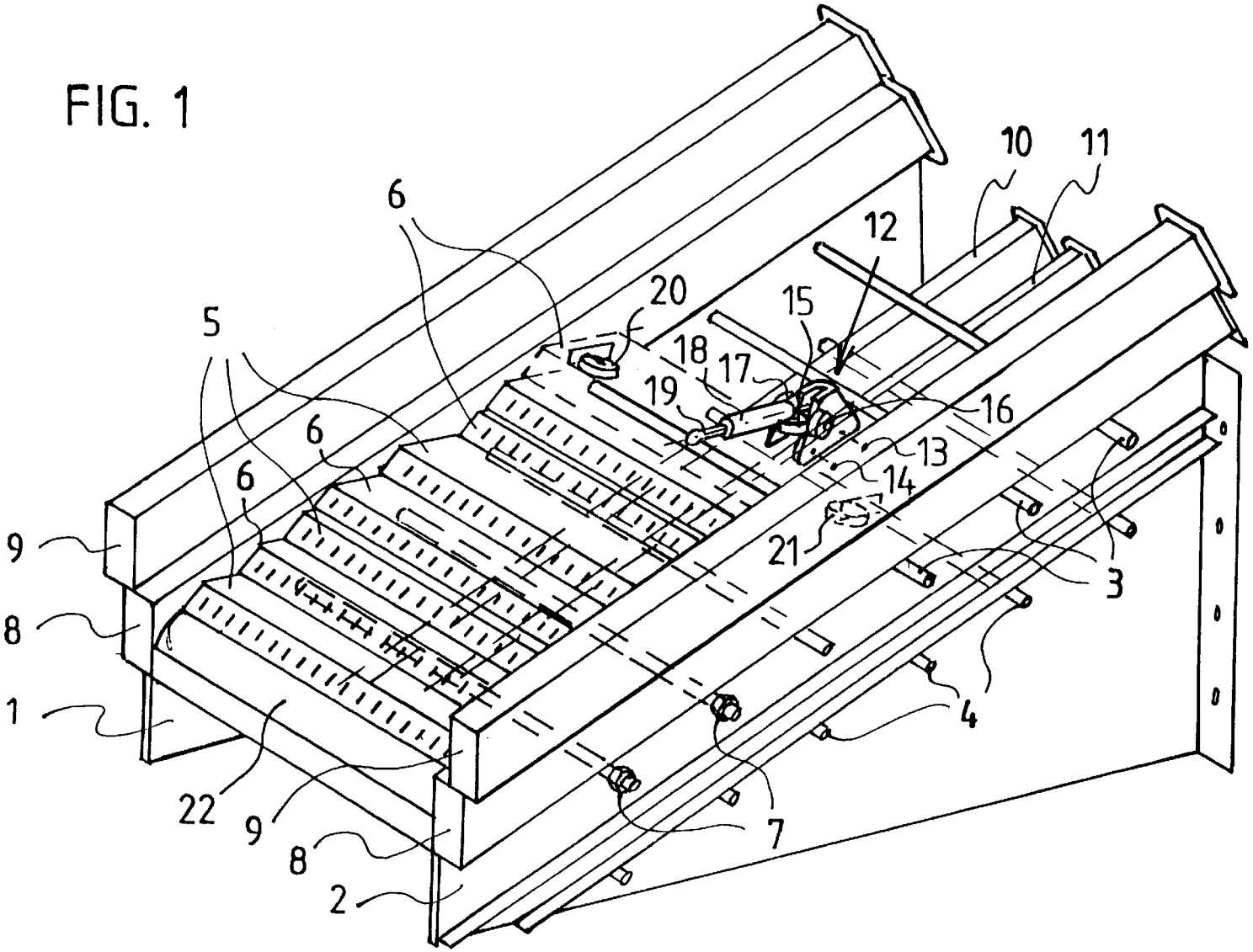
FIG. 1 is a perspective view of a portion of the length of a thrust combustion grate with partially removed grate plates in accordance with one embodiment of this invention.

The basic structure of the thrust combustion grate of this invention with its essential elements is shown most clearly in FIG. 1. FIG. 1 shows a portion of a length of the grate in a perspective view, as it would look like during assembly, that is with some grate plates missing, giving a clear view of the substructure. The grate is sloped downwards in the direction of conveyance. Two vertical steel walls 1,2 disposed parallel to each other, are stably connected to each other by a plurality of distancing bars 3,4. These distancing bars 3,4 run crosswise to the orate and extend across the inside width between the two vertical steel walls 1,2 at two different levels. The two vertical steel walls 1,2 in accordance with one embodiment of this invention comprise a plurality of steel panels or parts screwed together in a suitable manner. Distancing bars 3,4, threaded at both ends, penetrate the two vertical steel walls 1, 2 and are screwed tightly to the vertical steel walls 1,2 by means of tapered ends and nuts 7. The top level of distancing bars or crossbars 3 also serve as supporting rods for the stationary grate plates 5 lying on top of them. The front edge of the bottom stationary grate plate 5 abuts against a discharge lip 22 welded in place between vertical steel walls 1,2, while its rear section is suspended over the first top distancing bar or crossbar 3. Next in line is a movable grate plate 6, the front underedge of which rests on the first stationary grate plate 5 below. The front underedge of the next highest stationary grate plate 5 rests in turn on movable grate plate 6 and so on. The sloped front side of the individual grate plates is perforated by primary air slots 25, through which the primary air for the combustion is blown from below. Along the upper edge of vertical steel walls 1,2 are two hollow profiles in the form of square pipes or conduits 8,9 disposed on top of each other in a slightly offset manner, the lower ends of which are sealed by welding. These square pipes 8,9 constitute the side panels of the grateway and limit the sides of the combustion bed when the grate is in operation. They are water-cooled and are forcibly flooded with water from bottom to top so that their insides are always completely filled with water. The individual grate plates 5,6 are made from sheet steel and are also designed as hollow bodies that are forcibly flooded with water so that their insides are always completely filled with water, thereby preventing the formation of air bubbles. All the sheet steel parts of the grate, whether lateral panels 8,9 or grate plates 5,6, that come into contact with the material to be combusted are, therefore, continuously covered with water on the back side of the sheet steel. This means that all the parts in contact with the fire are cooled continuously and kept at a stable temperature so that practically no dilatation occurs. This obviates the need to provide compensatory elements of any kind to the sides of the grate plates. This means that the construction of the grate can be considerably simplified. The stability of the grate construction is essentially achieved by the distancing bars or crossbars 3,4, which strut and brace the two vertical steel walls 1,2 on two parallel levels as already described. Between these two levels of crossbars 3,4, running along the grate on both sides of its center are two other hollow profiles in the form of square pipes or conduits 10,11, which are connected at the bottom and at the top at some points to the crossbars 3,4, running perpendicular to them. One of the square pipes, namely square pipe 10, feeds the cooling water from bottom to top for grate plates 5,6, whilst the other square pipe 11 supplies flushing and cooling air for the drives of movable grate plates 6, as will be described in detail below. Disposed between these two parallel-running square pipes 10,11 are supporting elements 12 for movable grate plates 6. These supporting elements 12 are fixed to the square pipes by two bolts 13,14 that run through the two square pipes 10,11. For this purpose, the square pipes or hollow profiles 10,11 have welded-in crossbars with an inside diameter designed to accommodate the retaining bolts 13,14 for the supporting elements 12. The supporting elements 12 themselves each have steel roller 15 disposed parallel to the corresponding grate plate plane, as well as, to the left and right, a steel roller 16,17 acting in the vertical plane. At the same time, connected to every supporting element 12, there is a hydraulic cylinder 18, having a piston rod 19 connected to the underside of the movable grate plate 6 which it drives. The grate plate itself, which rests on the supporting element 12 illustrated here, is only indicated here by dashed lines. On its underside, the grate plate forms a central guide groove, with which it rests on steel rollers 16,17, which, when the grate plate is displaced, roll along the floor of this guide groove. The inside width of the guide groove is chosen so that it is slightly larger than the diameter of the lying steel roller 15, thereby ensuring that the grate plate is sufficiently guided by roller 15 crosswise to the grateway. To guide the front side of the movable grate plate, additional steel rollers 20,21 are mounted on panels 8. The front underside of the associated movable grate plate is provided at the sides with recesses contrived so that at each side, a guiding surface is formed that runs parallel to the side surface of the grate plate but set back thereto, and on which these steel rollers 20,21 roll during the to and fro movement. Thus, every movable grate plate has a three-point bearing, so to speak. To the rear in the center, where the drive is located, the grate plate is guided horizontally and vertically by associated steel rollers 15,16,17, and at the front, it is guided on the left and right sides by steel rollers 20,21 while its front underedge rests on the next stationary grate plate down and slides on it as it moves to and fro. For this purpose its front underedge is provided with a sliding shoe made from abrasion-resistant material which can be changed from time to time without the actual grate plate having to be replaced. An advantage of this construction is that the movable grate plates are guided accurately, and friction no longer occurs along the sides because the lateral guiding arrangement is adjusted so that between the side edge of movable grate plate 6 and adjacent panel 8 there is always a small gap, that is small enough to prevent jamming small parts from falling into the gap, and wide enough to ensure that no sliding friction occurs. Because of this accurate guide arrangement, the grate plate can no longer skew to the side as it can with conventional constructions. Previously, when skewing occurred, the plate was simply moved back and forth against the enormously increased sliding friction with great force until the jamming object causing the skewing fell down or worked itself out of the gap between the grate plate and the panel. Until that occurred, however, there was time for big sliding friction forces to develop, which caused correspondingly high wear and tear. This wear and tear is eliminated by means of the arrangement shown hear for mounting and guiding the movable orate plates, which increases their service life. Another advantage of the construction is that, because the grate plates are guided on steel rollers, the forces needed to operate them are considerably smaller than when pure sliding friction has to be overcome. This, in turn, allows the use of small drive units in the form of compact hydraulic cylinder-piston units, with a separate such drive unit for each individual movable grate plate. Thus, each movable grate plate can be driven individually, which coincides with the requirements for maintaining as geometric a fire as possible. Depending on the progress of the combustion and the behaviour of the material being combusted, the operator can stoke the fire in certain specific places by small lifting movements of the grate plates, or he can transport the material being combusted along the grate with larger movements. The constructive solution of this invention with the supporting elements 12 disposed between the two longitudinally running square pipes 10,11 even allows any one drive unit to be replaced when the grate is in operation. This is possible because the grate plates 5,6 either stretch individually across the entire width of the grateway in accordance with one embodiment, or in accordance with another embodiment, a plurality of grate plates are connected next to each other in such a way that they cover the entire width of the grateway without any gaps between them so that virtually nothing can fall through the grate and onto the engineers underneath. Where a plurality of grate plates is connected together to form one grate level, this is done, in accordance with one embodiment of this invention, by screwing or welding together the individual grate plates that each extend across one part of the width of the grateway. In this manner, two or more adjacently disposed grate plates can be joined to form a single grate level. Furthermore, the water-cooling of the entire combustion bed ensures that the temperature underneath the grate is kept within a range that allows engineers to remain and work under the grate without any problems. Finally, every supporting element 12 is suspended by bolts 13,14 on square pipes 10,11 in such a way that the rear bolt 13 can be disengaged and the whole supporting element tilted backwards so that the hinge of the hydraulic cylinder 18 becomes accessible, allowing the cylinder to be disassembled quite easily. FIG. 1 shows a portion of the length of a grateway. The entire grateway often consists of several such sections. For this purpose the ends of square pipes 10,11 and panels 8,9 are fitted with flanges 51,52 so that they can be sealingly connected to the panels and square pipes of the adjoining section. This construction makes it possible to prepare individual portions of the length of a grateway in the workshop ready for assembly, whereby entire grateway portions can then be quickly assembled on-site. This avoids both complicated special transport and lengthy on-site assembly work. The water-cooling of the grate plates is effected by connections to square pipe 10, in which cooling water flows from bottom to top. Starting from an open compensating tank located, for example, at approximately the same level as the feed-in channel or higher, cooling water is pumped through a pipe by an electric pump at the bottom into square pipe 10, inside which it is kept at a pressure of 3–4 bar. Each set of two adjacent grate plates is connected in series to a cooling cycle because, together, they always form a constant grate surface. For this purpose, water is withdrawn for each set of two grate plates from the square pipe 10 running below through a nipple or a socket and fed into the first grate plate through a temperature-resistant conduit. Inside, the water is forcibly made to flow through a labyrinth designed so that no air bubbles can form anywhere, and so that the entire hollow space inside the grate plate is completely filled with water. At the end of the flow channel inside the grate plate, there is another connection from which another temperature-resistant conduit leads to the second adjacent grate plate in which the water again flows through a channel, at the end of which it is fed through a hose into a return pipe which itself feeds back into the open compensating tank. Thus, for every two neighbouring grate plates there is a water connection point on square pipe 10, and the corresponding cooling water is fed back to the compensating tank through an individual return pipe. Square pipe 11, on the other hand, does not convey water, but rather air at excess pressure is maintained by an air pump for the following reason: for every movable grate plate, there is a separate drive unit with an hydraulic cylinder. These hydraulic cylinders are each housed in a pipe jacket such that a gap remains between the jacket and the actual hydraulic cylinder. This gap is flushed with air from square pipe 11 so that the pipe jacket forms a flushing cylinder. For this purpose, air is drawn off from inside the square pipe 11 through a connection at every point along the square pipe 11 where there is a hydraulic cylinder, and this air is fed through a conduit into the pipe jacket which encases the hydraulic cylinder to form the flushing cylinder. The pipe jacket is open at the front so that the flushing air can flow out again to end up in a zone below the grate where it mixes with the primary air. The volumes of this flushing air are negligible in comparison with the volume of primary air, however, and they therefore have scarcely any effect on the combustion. This flushing of the pipe jackets keeps the actual hydraulic cylinders and piston rods projecting from them free of dust and dirt, thereby helping to extend the service life of the drive units. In addition, this circulating air provides a cooling effect which contributes to ensuring that the hydraulic oil never overheats. The area underneath the grate plates is divided along the length of the grateway into several downdraught zones. Built-in underneath each stationary grate plate there is a separating wall which separates adjacent downdraught zones in a virtually airtight manner. Primary air is blown into the individual downdraught zones by means of separate ventilators, and this air then reaches the combustion air through the primary air slots. The volume of primary air can be regulated by varying the speed of the individual ventilators. This ability to vary the supply of primary air to the individual grate zones also helps to form a geometric fire in that the fire can be fed with exactly the required volume of air in a targeted and local manner.

Figure 2:
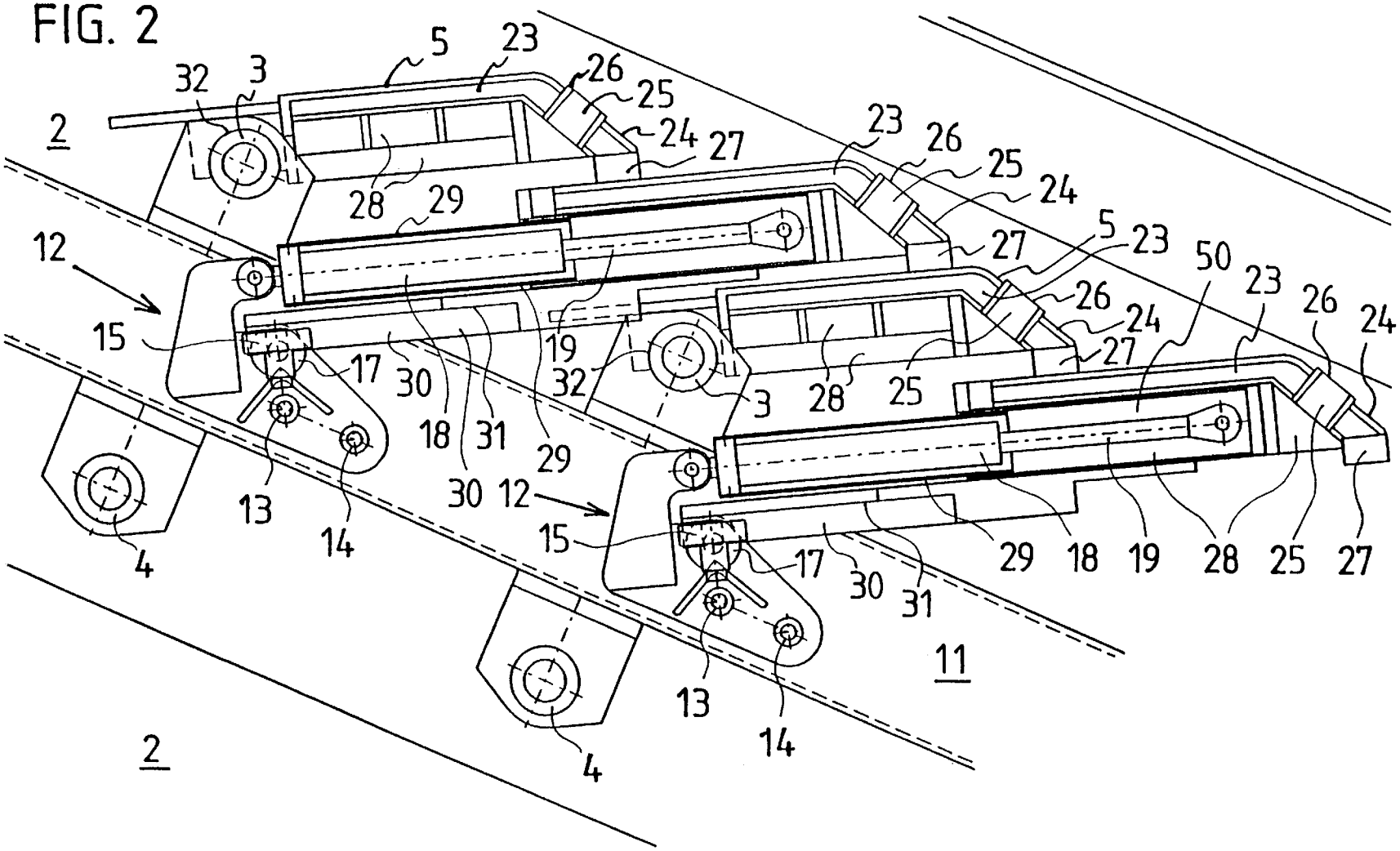
FIG. 2 is a side view of four grate plates of a thrust combustion grate in a longitudinal section in accordance with one embodiment of this invention.

FIG. 2 shows a side view of a section from four consecutive grate plates of the thrust combustion grate in accordance with one embodiment of this invention in a section along the center of the grateway. At the sides, the stationary and movable grate plates 5,6 are maintained at a distance from panel 8. As shown in FIG. 1, above panel 8 is disposed panel 9. These two water-cooled panels 8,9 form the lateral limit of the combustion bed. Compensating elements are, therefore, no longer required between them and grate plates 5,6. Grate plates 5,6 are made from sheet steel and are hollow. The hollow space is divided up by walls so as to form a flow channel 23, that zigzags back and forth. This flow channel 23 is generally designed to run from bottom to top so that water is forcibly made to flow through it, thereby preventing air bubbles from forming anywhere on the inside. The grate plates themselves are tilted, as a result of which the inflowing water under pressure generally flows from the back and the bottom to the front and the top. At the same time, the flow channel is arranged so that it runs along the entire surface of the grate plate so that all parts in contact with the fire are continuously in direct contact with the water on the rear side, and thereby cooled. The fronts of the grate plates are inclined and the slopes 24 are perforated with a plurality of primary air slots 25. These slots are formed by ducts 25 with an elongated cross-section which pass through the grate plate and are welded into it. The edges of ducts 25,26 project slightly beyond the surface of the grate plates. Primary air for the combustion is blown from below the grate plates onto the grates through these slots 25 so that there is a dominant flow of air which prevents small particles from falling through. The edges 26 projecting slightly beyond the grate also effectively prevent non-ferrous metals or other small parts from falling through the slots 25. Such particles are far more likely to slip down the slope 24 and are moved around slots 25 by the projecting edge. At the bottom front edge of the grate plates are disposed sliding shoes 27 made of abrasion-resistant material. With these sliding shoes 27, each grate plate rests snugly and virtually sealingly on the next grate plate down. These sliding shoes are steel elements that are fitted onto a holding strip alone the underedge of the grate plate and fixed to it with bolts, with the bolt heads being welded to the sliding shoes. To replace the sliding shoe, the bolt heads are around away, whereupon the bolts can be knocked out and the sliding shoes removed. On their underside, both the stationary grate plates 5 and movable grate plates 6 are provided with a framework 28 made from steel sheets, which gives them the necessary form and stability. In the case of the movable grate plates 6, the framework is disposed in the middle and is designed so that a recess 50 is formed to accommodate the hollow cylinder 18 relative to its pipe jacket 29. As shown in FIG. 2, piston rods 19 project out of the hydraulic cylinder 18 and are connected at their ends to grate plate 6 by a bolt (not shown). The hydraulic cylinders respective to the pipe jackets 29 encasing them are connected at the rear to supporting elements 12. To prevent the hydraulic oil from overheating when the grate is operated, and to ensure additional cooling for the piston-cylinder unit as well, the hydraulic oil is allowed to circulate continuously through the cylinder. It flows into the cylinder 18 at one connection point and out at another. To operate the drive, that is to extend the piston, a stop valve is operated at the outlet so that more hydraulic oil flows into the cylinder 18 than can flow out. As soon as the piston rod 19 is completely extended, or extended as far as required, this stop valve is reopened so that as much hydraulic oil can flow out of the cylinder 18 as flows in. Hence there is a constant flow of hydraulic oil around cylinder 18, although the cylinder is not working. The hydraulic oil conveys heat away and is then recooled in an oil cooler next to the rear hydraulic pump associated with the drive. Conversely, when the piston is to be driven into the cylinder 18, a similar operation is carried out on the cylinder 18 on the opposite side of the piston. Accordingly, more hydraulic oil flows into cylinder 18 on that side of the piston than can flow away, so that the piston is driven in, and on the other side more hydraulic oil flows out of cylinder 18 during this process than flows in. By switching and controlling the hydraulic oil circuits in this manner, the hydraulic cylinder-piston unit is cooled continuously. The hydraulic cylinder 18 respective to the flushing cylinder 29 for the flushing air encasing the cylinder is connected to the associated supporting element 12 in such a way that it can easily be removed. For this purpose, the supporting elements 12 are fixed to both square pipes 10,11 by two bolts 13,14, although only square pipe 11 is visible here. If bolt 13 is removed. supporting element 12 can be folded down around bolt 14, counterclockwise in this figure, thereby giving free access to the rear connection point of hydraulic cylinder 18 and allowing disassembly of the latter. The figure shows the horizontally disposed steel roller 15 on supporting elements 12 and the vertical steel rollers 16,17. On the rear underside of the movable grate plates 6 there is an extension which forms a guide groove 30, the floor 31 of which runs on vertical steel rollers 16,17, and the side walls of which run on both sides of the horizontally oriented steel roller 15 with very little play. As a result, at the rear side of the movable grate plates 6, only rolling friction has to be overcome. Sliding friction occurs solely on the top side of the grate plate 6 as a result of the sliding shoe 27 resting on it belonging to the next stationary grate plate 5 up, and from the plate's own sliding shoe 27 which rests on the next stationary grate plate 5 down. The stationary grate plates 5 themselves have, on their rear underside, an approximately semi-cylindrical recess 32, by means of which they rest on crossbars 3, which run between vertical steel walls 1,2. The only function of the bottom crossbars 4 is to stablize the entire grateway construction.

Figure 3:
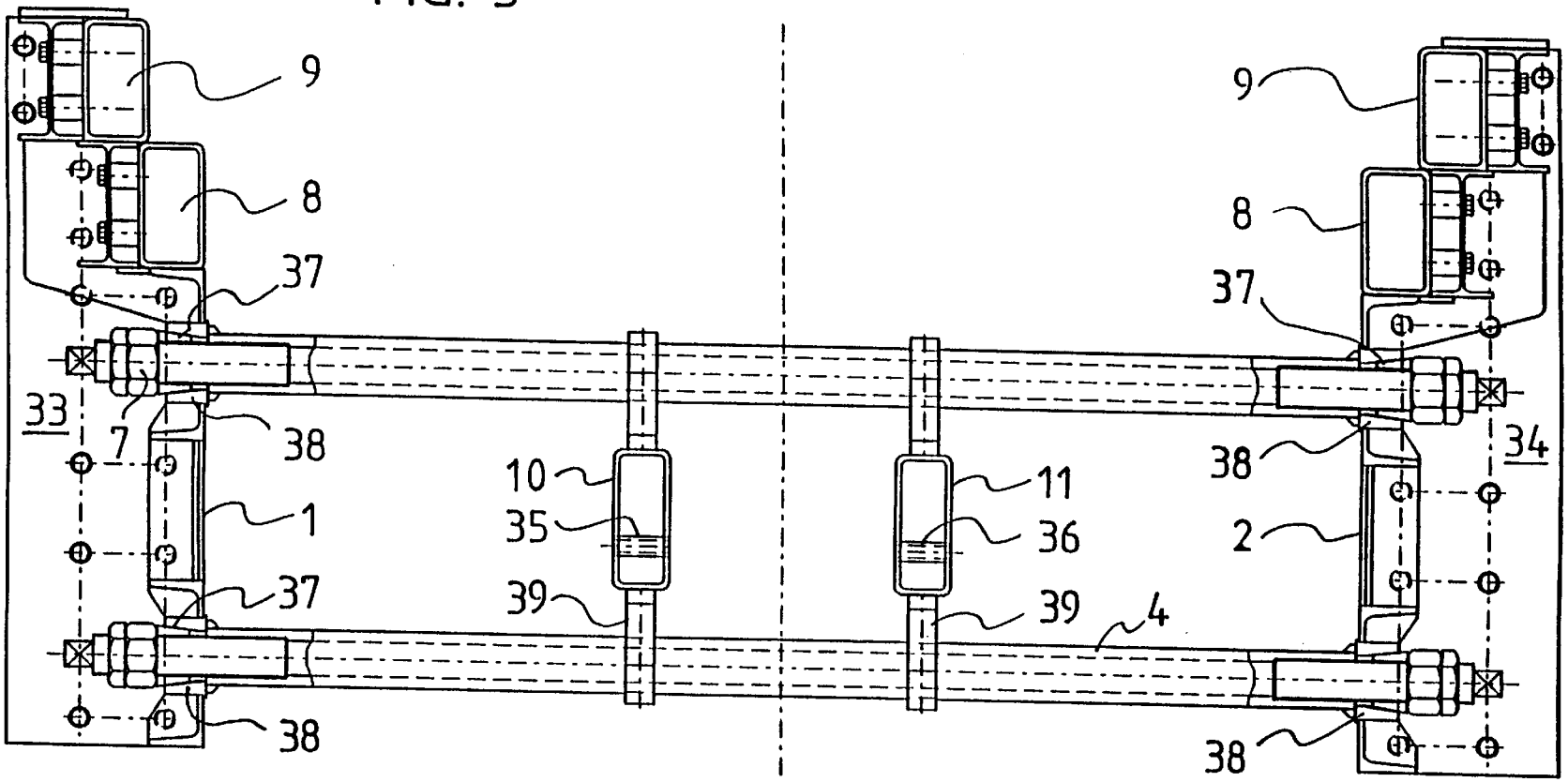
FIG. 3 is a cross-sectional view through a combustion grate relative to the grate substructure, without the grate plates, in accordance with one embodiment of this invention.

FIG. 3 shows a cross-section through the grate structure respective to the grate substructure, without the grate plates. The vertical steel walls 1,2 form the side walls of the grateway. Disposed perpendicular thereto are, in accordance with one embodiment, additional steel walls 33,34 with holes so that several grateway sections can be flanged together. At the top of the side walls, square pipes 8,9 are shown which function as water-cooled side panels for the combustion bed. The grate plates all lie exclusively between panels 8. Both side walls 1,2 are braced together on two levels by distancing bars or crossbars 3,4. Fitted over the ends of crossbars 3,4 are tapered ends 37 which are pressed by nuts 7 against counter-tapered ends 38 so that a stable frame construction is formed. The nuts 7 are reinforced with locking nuts. Between the two levels of crossbars 3 and 4. Run square pipes 10 and 11, of which one feeds cooling water and the other flushing air for hydraulic cylinders 18. These square pipes 10,11 are held by connecting elements 39 to certain of the crossbars 3,4. They are themselves transpierced by ducts 35,36, through which bolts 13,14 for fixing supporting elements 12 in place can be pushed, as shown in FIGS. 1 and 2.

Figure 4:
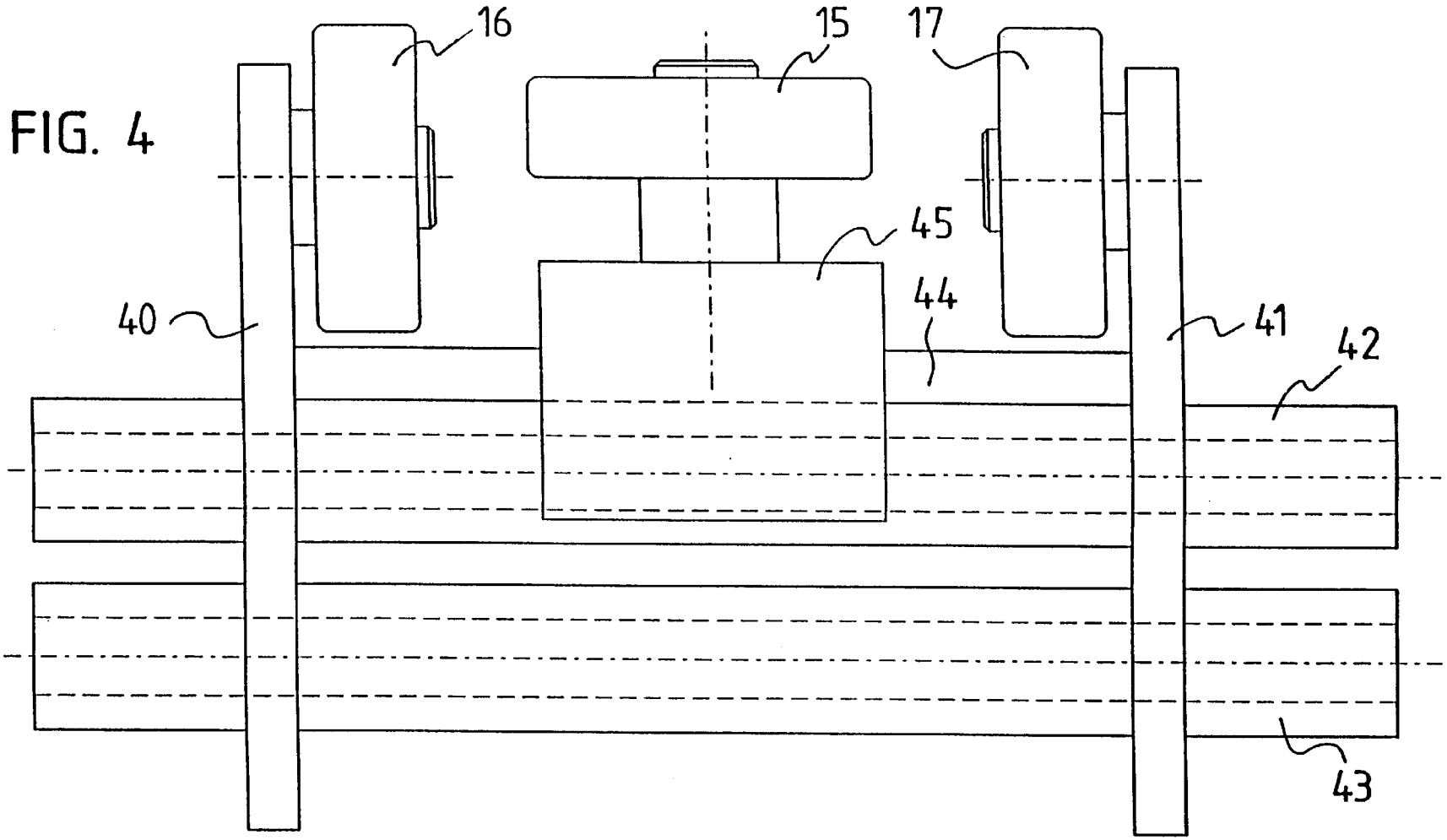
FIG. 4 is a frontal view of a supporting element for assembly between two conduits along a grate in accordance with one embodiment of this invention.

FIG. 4 shows a supporting element 12 disposed in between the two hollow profiles 10,11 along the grate, seen from the front. The supporting element has two side plates 40,41 which are transpierced by ducts 42,43. These ducts 42,43 accommodate fastening bolts 13,14. The vertical steel rollers 16,17 are attached to and mounted on side plates 40,41. Both side plates 40,41 are welded together at the back by a connecting plate 44. This connecting plate 44 carries the pillow block 45 for the steel roller 15 that is horizontally disposed and mounted on it.

Figure 5:
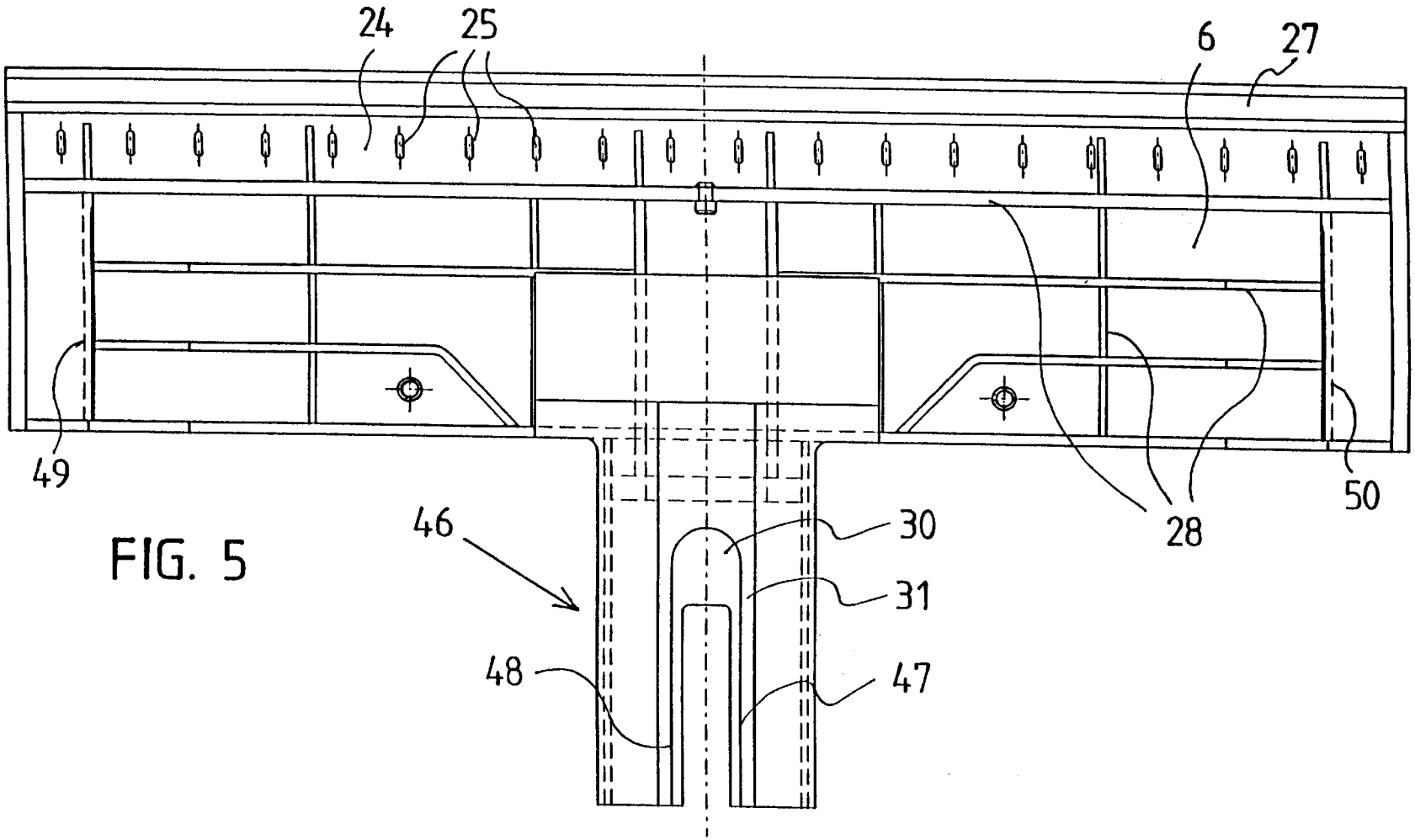
FIG. 5 is an underside view of a movable grate plate in accordance with one embodiment of this invention.

FIG. 5 shows a movable grate plate 6 seen from below. The framework made from steel sheeting 28, which stabilizes the grate plate, is clearly shown. Through the front sloping surface 24, seen here from below, there are a plurality of longitudinal slots 25 formed by welded-in ducts with a slit-like or elongated cross-section. On its rear side, the grate plate has an extension 46, which, on its underside, forms a guide groove 30 for steel rollers 15,16,17 on supporting element 12. Vertical steel rollers 16,17 roll along the floor 31 of guide groove 30, while the horizontal steel roller 15 rolls along both side walls 47,48 of guide groove 30. On the undersides of both sides of the grate plate there is also a guide wall 49,50. The horizontal steel rollers 20,21 mounted on the side panels 8 of the grateway roll on these guide walls 49,50 and define a minimum distance between the grate plate 6 and the side panel 8.

I claim:

1. In a water-cooled thrust combustion grate for burning refuse comprising a plurality of stationary hollow grate plates (5) alternating with movable hollow grate plates (6) in a stairway formation, said hollow grate plates (5,6) resting upon each other with a front underedge and extending across an entire width of a grateway, each of said hollow grate plates (5,6) comprising one of a single piece and a plurality of adjacently assembled plates that extend across said entire width of the grateway, each of said movable hollow grate plates (6) driven by a hydraulic cylinder-piston unit (18,19), the improvement comprising: two side panels, each comprising at least two water-cooled conduits (8,9), each said water-cooled conduit (8,9) comprising in a longitudinal direction, at least two sections sealingly flanged together, said panels rigidly secured to each other by a plurality of horizontally disposed distancing bars (3,4) disposed perpendicular to said panels; two air and water supply conduits (10,11) comprising at least two sections sealingly flanged together, said air and water supply conduits (10,11) providing flushing air and cooling water, and also fixedly secured to at least one of said horizontally disposed distancing bars (3,4); a stationary grate plate back side of each of the stationary grate plates (5) resting on one of said distancing bars (3) and a moving grate plate back side of each of the movable grate plates (6) resting on at least one back side steel roller (16,17) having a horizontal axis, each end of a front side of of each said movable grate plates being guided by a front side steel roller (20,21) having an axis perpendicular to said movable grate plate (6); and, a front portion of each of the hollow grate plates (5,6) sealingly forming a plurality of ducts (25) having an elongated hole in cross-section for feeding flushing air, said plurality of ducts (25) protruding beyond a surface of the hollow grate plates (5,6).

2. A water-cooled thrust combustion grate in accordance with claim 1, wherein said at least one back side steel roller (16,17) is connected to a supporting element (12) detachably mounted between the air and water supply conduits (10,11), and said supporting element 12 comprises a stationary connection point for the hydraulic cylinder-piston unit (18), said hydraulic cylinder-piston unit driving said movable hollow grate plate (6).

3. A water-cooled thrust combustion grate in accordance with claim 2, wherein said supporting element (12) is fixedly connected to the air and water supply conduits (10,11) by two bolts (13,14) disposed parallel to each other, whereby after removing one of said bolts (13), the supporting element (12) can be swung downwards, providing access to the hydraulic cylinder-piston unit (18) for disassembly.

4. A water-cooled thrust combustion grate in accordance with claim 2, wherein the supporting element (12) further comprises a central guiding roller (15) having a central guiding roller axis perpendicular to the plane of motion of said movable hollow grate plate (6), said movable hollow grate plate (6) forming a bottom guide groove (30) disposed in the direction of motion of said movable hollow grate plate (6), and said central guiding roller (15) disposed within said bottom guide groove (30), and two adjacently disposed said back side steel rollers (16,17) connected to said supporting element (12) and having back side steel roller axes parallel to the plane of motion and perpendicular to the direction of motion of said movable hollow grate plate (6) on which said movable hollow grate plate (6) moves.

5. A water-cooled thrust combustion grate in accordance with claim 4, wherein said supporting element (12) is fixed to the air and water supply conduits (10,11) by two bolts (13,14) disposed parallel to each other, whereby after removing one of said bolts (13), the supporting element (12) can be swung downwards, providing access to the hydraulic cylinder-piston unit (18) for disassembly.

6. A water-cooled thrust combustion grate in accordance with claim 1, wherein two steel rollers (20,21) for each said movable hollow grate plate (6) are disposed between said side panels, said two steel rollers (20,21) having axes perpendicular to a plane of motion of said movable hollow grate plate (6), and the undersides of the movable hollow grate plates (6) comprise at least one guide surface (49,50) set back with respect to the side panels which move on said steel rollers (20,21).

7. A water-cooled thrust combustion grate in accordance with claim 6, wherein a front underedge of each of said hollow grate plates (5,6) comprises a replaceable sliding shoe (27) made from an abrasion-resistant material, said replaceable sliding shoe (27) sealingly resting on top of an adjacent downstream hollow grate plate (5,6).

8. A water-cooled thrust combustion grate in accordance with claim 7, wherein said at least two water-cooled conduits (8,9) of each said side panel are disposed parallel to each other, one of said water-cooled conduits being disposed above and off-set with respect to another of said water-cooled conduits, whereby an inside distance between the upper said water-cooled conduits (9) of each said side panel is wider than the distance between the lower water-cooled conduits (8) of each said side panel, said upper water-cooled conduits (9) form a combustion bed side limitation and the lower water-cooled conduits (8) form a hollow grate plate side limitation.

9. A water-cooled thrust combustion grate in accordance with claim 8, wherein each said hydraulic cylinder-piston unit (18) is disposed in a flushing cylinder (29) and surrounded therein by air for cooling and preventing dust from entering through an open end at a front of said flushing cylinder (24) and a feed-in line and associated feed-out line in fluid communication with each of said hydraulic cylinder-piston units (18,19), supplying and flooding both sides of the piston with hydraulic oil, said feed-in line and said feed-out line being individually blockable to control each of the hydraulic cylinder-piston units (18,19) whereby the cylinder chamber is constantly flooded.

10. A water-cooled thrust combustion grate in accordance with claim 9, wherein a cooling cycle for the hollow grate plates (5,6) connected in series provides cooling for at least two adjacent hollow grate plates (5,6).

11. A water-cooled thrust combustion grate in accordance with claim 10, wherein an area underneath the grate is divided into a plurality of air zones separated sealingly from each other, each of said air zones being supplyable with air from an associated speed controllable ventilator .

12. A water-cooled thrust combustion grate in accordance with claim 1, wherein a front underedge of each of said hollow grate plates (5,6) comprises a replaceable sliding shoe (27) made from an abrasion-resistant material, said replaceable sliding shoe (27) sealingly resting on top of an adjacent downstream hollow grate plate (5,6).

13. A water-cooled thrust combustion grate in accordance with claim 1, wherein said at least two water-cooled conduits (8,9) of each said side panel are disposed parallel to each other, one of said water-cooled conduits being disposed above and off-set with respect to another of said water-cooled conduits, whereby an inside distance between the upper said water-cooled conduits (9) of each said side panel is wider than the distance between the lower water-cooled conduits (8) of each said side panel, said upper water-cooled conduits (9) form a combustion bed side limitation and the lower water-cooled conduits (8) form a hollow grate plates side limitation.

14. A water-cooled thrust combustion grate in accordance with claim 1, wherein each said hydraulic cylinder-piston unit (18) is disposed in a flushing cylinder (29) and surrounded therein by air for cooling and for preventing dust from entering through an open end at a front of said flushing cylinder (24) and a feed-in line and an associated feed-out line in fluid communication with each of said hydraulic cylinder-piston units (18,19), supplying and flooding both sides of the piston with hydraulic oil, said feed-in line and said feed-out line being individually blockable to control each of the hydraulic cylinder-piston units (18,19) whereby the cylinder chamber is constantly flooded.

15. A water-cooled thrust combustion grate in accordance with claim 1, wherein a cooling cycle for the hollow grate plates (5,6) connected in series provides cooling for at least two adjacent hollow grate plates (5,6).

16. A water-cooled thrust combustion grate in accordance with claim 1, wherein an area underneath the grate is divided into a plurality of air zones separated sealingly from each other, each of said air zones being supplyable with air from an associated speed controllable ventilator.

* * * * *